United States Patent [19]

Malkowski

[11] Patent Number: 4,956,200

[45] Date of Patent: Sep. 11, 1990

[54] TEXTURING A MOLD SURFACE

[75] Inventor: Paul Malkowski, Reisterstown, Md.

[73] Assignee: The Burns & Russell Company, Baltimore, Md.

[21] Appl. No.: 273,921

[22] Filed: Nov. 21, 1988

[51] Int. Cl.[5] ..... B44D 1/20

[52] U.S. Cl. ..... 427/133; 264/338; 427/135; 427/376.1; 427/419.2; 427/419.3

[58] Field of Search ..... 427/135, 133, 376.2, 427/419.2, 419.3; 264/338

[56] References Cited

U.S. PATENT DOCUMENTS

| | | | |
|---|---|---|---|
| 2,399,606 | 4/1946 | Schuh et al. | 427/135 |
| 2,454,910 | 11/1948 | Carr | 427/133 |
| 2,464,157 | 3/1949 | Scheer et al. | 427/135 |
| 3,116,524 | 1/1964 | Royal | 427/133 |
| 3,266,107 | 8/1966 | Groteke | 427/135 |
| 3,519,457 | 7/1970 | Hammerton et al. | 427/133 |
| 3,962,492 | 6/1976 | Phelp | 427/133 |
| 4,560,586 | 12/1985 | Tölle | 427/133 |

*Primary Examiner*—Janyce Bell

*Attorney, Agent, or Firm*—Cushman, Darby & Cushman

[57] ABSTRACT

A mold surface is first treated with an enameling composition which, while still unfused, is provided with a distribution of particulate material such as sand; the mold surface is then fired and then a second coating of predetermined thickness is applied over the first coating including the particulate material followed by a second firing to finish the mold.

22 Claims, 1 Drawing Sheet

TEXTURING A MOLD SURFACE

BACKGROUND AND SUMMARY OF THE INVENTION

The present invention relates to a method of preparing a mold surface for use in applying a facing composition to a substrate and to an improved mold useful in carrying out the substrate facing operation. More specifically, the present invention relates to an improved mold surface texturing process whereby a desired texture or pattern can be imported to the molded article without interfering with the color of the facing composition to be applied to the substrate but will impart a pleasing texture to the substrate facing composition.

In the art of applying decorative facing compositions to substrates such as building blocks, tiles or other construction articles, it has been desired to impart texture to the facing compositions in order to improve the appearance and "feel" of the applied surface. In the past, expensive and time consuming variations in the formulation of the facing composition material has been required in order to achieve any variations in the surface appearance or texture other than color of the facing composition. Thus, the uniformity of the appearance and texture of the facing compositions on the construction blocks or other materials to which the facing compositions are adhered has limited their use to certain environments since only a smooth, glaze-like surface texture could be achieved. Glazing compositions with which the present invention is particularly useful are disclosed in U.S. Pat. Nos. 4,031,289, 2,751,755, 3,328,231. U.S. Pat. No. 4,031,282 discloses a particular method of applying a decorative surface to obtain a desired appearance on a construction panel. Other coating compositions are disclosed in U.S. Pat. Nos. 3,194,724, 3,078,249 and 3,030,234. U.S. Pat. No. 4,533,568 discloses a method of treating a mold surface to impart a selected pattern to the molded composition in applying the composition to a substrate such as a masonry unit. The disclosures of the foregoing patents are incorporated herein by reference.

The present invention provides a method of preparing a mold surface and a mold itself which can more readily and expeditiously obtained to provide a unique texture to the facing composition at the time the facing composition is applied to a substrate such as a masonry unit including a cement or cinder block or tile member.

In a preferred embodiment, the mold surfaces of a conventional molding unit such as a shallow metal pan are first coated with a conventional enamel composition such as glass enamel or porcelain frit. Prior to fusing of the enameling composition, particulate material such as sand particles having a desired average screen size which may be varied to provide different effects in the resulting product are distributed either uniformly or in a random pattern over the bottom surface of the unfired enameling composition. The mold is then fired to fix the particulate material in place and harden the first coating. Subsequently, a second thin layer of the same or a different enameling composition is coated over the particulate material. The resulting compositely coated mold unit is then subjected to a final firing step such as by kiln drying.

The mold is then used in a conventional manner in the application of a decorative facing to a substrate such as a masonry or construction unit and will result in the formation of a pleasing texture to the facing composition, particularly those of the type disclosed in the foregoing commonly assigned patents.

From the description that follows, it will be apparent that the present invention provides a very economical method for either altering a previously coated mold or manufacturing a new mold element for applying a desired pattern or texture to a facing composition In addition, previously employed conventional ceramic or enamel coated mold units can be readily adapted at minor expense in terms of labor and time so as to be able to impact a desired texture to a facing composition even where such mold units have been partially damaged or defaced such as by cracking, grazing or the like.

The foregoing and other advantages will become apparent as consideration is given to the following detailed description taken in conjunction with the accompanying drawings, in which:

DETAILED DESCRIPTION OF THE INVENTION

Figure 1:
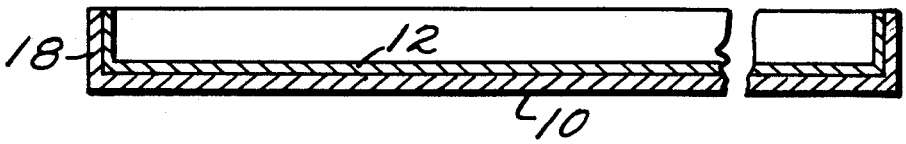
FIG. 1 is a side view and section of a mold element of the present invention.
Figure 2:
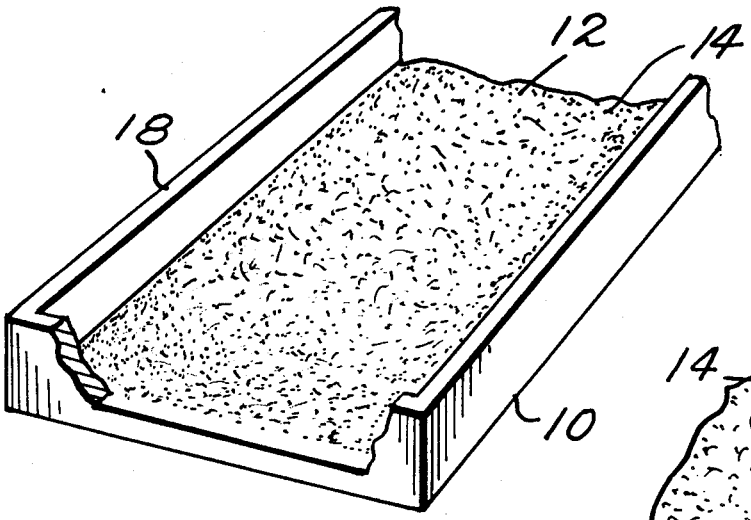
FIG. 2 ia a perspective view of a portion of the mold element of FIG. 1.
Figure 3:
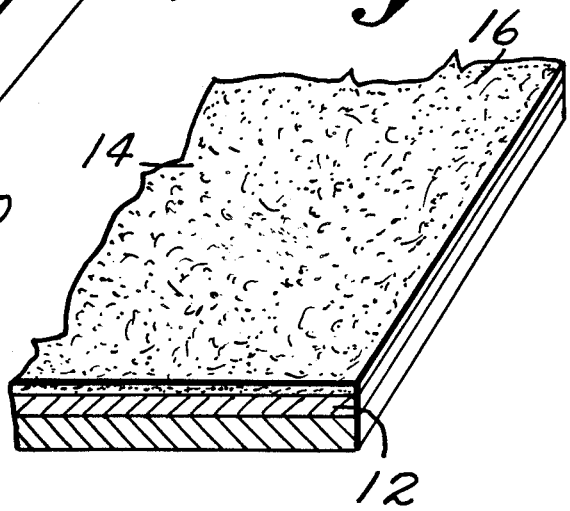
FIG. 3 is an enlarged section view and elevation of a coated mold of the present invention.
Figure 4:
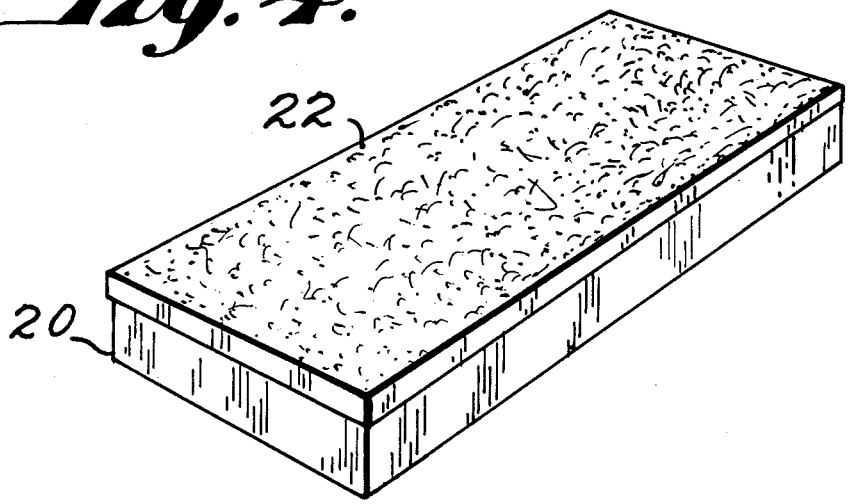
FIG. 4 is a perspective view of a block coated by use of the mold of the present invention.

In carrying out the present invention, a mold pan 10 is first coated with a conventional enameling composition which is fusible such as by heating to provide a hard and durable molding surface 12 over the interior surface of the mold pan 10. Glass enamel, ceramic, and porcelain frit are frequently used in this context and may be employed in the present invention.

It will be noted that where a previously used conventional mold pan 10 has been damaged such as by cracking, fracture or chipping of the surface 12, such a damaged mold pan may still be employed in the present invention since the user may simply recoat the interior surface of the damaged pan to provide the desired uniform surface 12.

According to the present invention, either with a new or used mold pan with the enameling composition coated thereon and in an unfired or "wet" state, particulate material preferably in the form of sand particles preferably of the approximately the same screen mesh size are distributed over the surface 12 which is usually sufficiently tacky so as to retain the particles upon contact with the tacky surface 12. The texturing effect on the resulting produce can be readily varied by appropriate selection of the size of the particulate material which is dispersed over the surface 12 of the mold pan 10.

Preferably a screen mesh of 40 is used although adequate results could be obtained for mesh of between 100–20. In addition for 8" by 16" mold, 10 to 12 grams of 40 mesh sand gives a pleasing effect. A loading of as much as 0.5 grams to 40 grams may be used for such a size of the mold surface and preferably 0.078 grams/in$^2$ to 0.094 grams/in$^2$. A loading as little as 0.004 to 0.31 grams square inch may be used. After depositing the particulate material 14 over the still unfused composition 12, the mold pan 10 is then fired, such as in a kiln at about 1500° F. to fix the particles in place and to harden the enameling composition 12.

It will be apparent that various types of particulate materials having particles of varying sizes may be employed. For some types of particulate materials such as silicates and aluminum oxide, where larger sizes are employed such as on the order of 4 mesh, care must be employed in subjecting such particulate materials to temperature changes to minimize or avoid thermal reactions which can lead to cracking or exploding of the individual particles. For example, gradual temperature changes may be employed to minimize stresses in particles of such materials.

Thereafter, a second coating 16 is applied over the anchored particles 14 and other portions of the first enameling composition 12. The mold pan is then fired a second time, to harden the second composition 16. Thereafter, the mold pan 10 is ready for use.

The pan is used in the conventional manner such as described in the above-noted U.S. Patents. In summary, a facing composition preferably in slurry form such as described in the foregoing patents is deposited in the mold pan 10. Then a building unit such as a masonry block having a surface slightly smaller than the surface bounded by the side walls 18 of the mold pan 10 is inserted into the mold pan. In this condition, the mold pan and inserted block are heated to cure the facing composition. Upon completion of the curing step, the finished block 20 is removed from the mold pan 10 and will carry on one of its faces and adjacent peripheral edges a facing coating 22 which will display a pleasing textured appearance to an observer.

The present invention is particularly useful with the coating composition such as disclosed in U.S. Pat. Nos. 1,761,775, 3,328,231, 3,632,725 and U.S. Pat. No. 4,030,289, the disclosure of which are hereby incorporated by reference, and which have been successfully applied to the porous surface of building blocks, including cinder and concrete blocks, to impart a decorative and protective surface finish in the form of a hardened glaze to such units.

It will be apparent to those skilled in the art that other materials may be used in place of the particulate material to impart differing appearances to the resulting glaze coating on the block material. In addition, selected patterns can be impressed on the molded coating, if desired, by selectively applying the particulate material to the first enamel composition. This may be done most easily by careful spray application of the particulate material.

Having described the invention, it will be apparent to those skilled in the art that various modifications in addition to those discussed above, may be made to the invention without departing from the spirit and scope of this invention as defined in the appended claims.

What is claimed is:

1. A method of making a mold with a textured mold surface comprising the steps of:

coating a mold surface of the mold with a fusible inorganic enamel composition, then applying a particulate inorganic material to the unfused enamel composition coating, and heating the enamel composition to fix the particulate material in place thereon and to harden the enamel composition, then applying a second coating of inorganic enameling composition of thickness to the coated mold surface and particulate material so that the surface of the second coating reflects the texture of the hardened enamel composition with the particulate material fixed thereon.

2. A method as claimed as in claim 1 wherein said second coating material is an enameling composition.

3. The method of claim 2 wherein said enameling composition is a ceramic material and including the step of fusing said second coating after application to said fusible enamel composition.

4. The method of claim 2 wherein said particulate material is sand.

5. The method of claim 4 wherein the sand has a screen mesh size of between 100 and 20.

6. The method of claim 5 wherein the sand has a screen mesh size of 40.

7. The method of claim 1 wherein said enamel composition in glass enamel.

8. The method of claim 1 wherein said enamel composition is porcelain frit.

9. The method of claim 1 wherein said curing step includes the step of subjecting the coated mold element to kiln firing.

10. The method of claim 1 including the step of applying the particulate material in a pattern.

11. The method of claim 1 including the step of applying the particulate material at a loading of between approximately 0.004–0.31 grams/square inch.

12. The method of claim 11 wherein the loading is between approximately 0.078 to 0.094 grams/square inch.

13. A method of making a mold with a textured mold surface comprising the steps of:

coating a mold surface of the mold with a fusible inorganic first enamel composition coating, then applying a particulate inorganic material to the unfused first coating, then heating the first coating to fix the particulate material in place thereon and to harden the first coating, then applying a fusible second inorganic enamel composition coating to the hardened first coating with the particulate material fixed thereon, the second coating having a thickness so that the surface of the second coating reflects the texture of the hardened first coating with the particulate material fixed thereon, wherein the particulate material is a silicate or aluminum oxide, wherein the first enamel composition coating is a glass enamel or a porcelain frit, and wherein the second enamel composition coating is a glass enamel or a porcelain frit.

14. The method of claim 13 further including the step of fusing said second coating after application to said first coating with the particulate material fixed thereon.

15. The method of claim 13 wherein said first enamel composition coating and said second enamel composition coating are the same material.

16. The method of claim 13 wherein the particulate material has a screen mesh size of between 100 and 20.

17. The method of claim 16 wherein the particulate material has a screen mesh size of 40.

18. The method of claim 13 wherein said heating occurs by kiln firing.

19. The method of claim 14 wherein said fusing of said second coating occurs by kiln firing.

20. The method of claim 13 wherein said particulate material is applied in a pattern.

21. The method of claim 13 wherein said particulate material is applied at a loading of between approximately 0.004–0.31 grams/square inch.

22. The method of claim 21 wherein the loading is between approximately 0.078 to 0.094 grams/square inch.

* * * * *